US006659742B2

(12) United States Patent
Oofuchi

(10) Patent No.: US 6,659,742 B2
(45) Date of Patent: Dec. 9, 2003

(54) DIRECTIONAL FLOW VALVE STRUCTURE FOR RECIPROCATING COMPRESSORS

(75) Inventor: Satoshi Oofuchi, Isesaki (JP)

(73) Assignee: Sanden Corporation, Gunma (JP)

( * ) Notice: Subject to any disclaimer, the term of this patent is extended or adjusted under 35 U.S.C. 154(b) by 51 days.

(21) Appl. No.: 10/084,465

(22) Filed: Feb. 28, 2002

(65) Prior Publication Data

US 2002/0141883 A1 Oct. 3, 2002

(30) Foreign Application Priority Data

Mar. 27, 2001 (JP) ..... P2001-091465

(51) Int. Cl.[7] ..... F04B 39/10; F04B 1/12; F16K 15/16

(52) U.S. Cl. ..... 417/571; 417/269; 137/856

(58) Field of Search ..... 417/269, 540, 417/542, 571; 137/856, 855

(56) References Cited

U.S. PATENT DOCUMENTS

| | | | | |
|---|---|---|---|---|
| 4,011,029 A | | 3/1977 | Shimizu | |
| 4,039,270 A | | 8/1977 | Hiraga | |
| 4,730,996 A | * | 3/1988 | Akatsuchi et al. | 418/15 |
| 4,867,650 A | * | 9/1989 | Ikeda et al. | 417/269 |
| 4,886,424 A | * | 12/1989 | Ikeda et al. | 417/269 |
| 5,213,488 A | | 5/1993 | Takahashi | |
| 5,242,276 A | | 9/1993 | Shimizu | |
| 5,249,939 A | | 10/1993 | Takahashi | |
| 5,380,176 A | | 1/1995 | Kikuchi et al. | |
| 5,586,874 A | | 12/1996 | Hashimoto et al. | |
| 5,647,395 A | | 7/1997 | Hashimoto et al. | |
| 6,006,786 A | | 12/1999 | Ito | |
| 6,026,721 A | | 2/2000 | Fukai | |
| 6,257,848 B1 | | 7/2001 | Terauchi | |
| 6,332,762 B1 | | 12/2001 | Tsukamoto | |
| 6,336,795 B1 | * | 1/2002 | Yamada | 417/569 |
| 6,419,467 B1 | * | 7/2002 | Murase et al. | 417/504 |
| 2001/0008609 A1 | | 7/2001 | Hashimoto et al. | |

FOREIGN PATENT DOCUMENTS

| | | | |
|---|---|---|---|
| JP | 2000-329066 | * 11/2000 | F04B/29/10 |

* cited by examiner

*Primary Examiner*—Cheryl J. Tyler
*Assistant Examiner*—Timothy P. Solak
(74) *Attorney, Agent, or Firm*—Baker Botts L.L.P.

(57) ABSTRACT

A refrigerant compressor includes a front housing, a cylinder block, a rear housing, and a valve plate positioned between the cylinder block and the rear housing, in which the valve plate has a suction hole formed therethrough. The compressor also includes a suction chamber and a suction valve reed formed on the valve plate. The compressor further includes a limiting recess formed within an end of the cylinder block adapted to receive the suction valve reed. The limiting recess includes an arced segment intersecting a center axis of the suction valve reed. Moreover, the portion of the arced segment which intersects the center axis of the suction valve reed has a corresponding tangential line at the point of intersection which forms an oblique angle relative to the center axis of the suction valve reed.

12 Claims, 5 Drawing Sheets

DIRECTIONAL FLOW VALVE STRUCTURE FOR RECIPROCATING COMPRESSORS

BACKGROUND OF THE INVENTION

1. Field of the Invention

The invention relates generally to reciprocating compressors for use in an air conditioning system of a vehicle. More particularly, the invention relates to reciprocating compressors having an improved refrigerant suction efficiency.

2. Description of Related Art

Reciprocating compressors may include swash plate-type compressors, wobble plate-type compressors, or the like. Referring to FIG. 1, a known, wobble plate-type compressor 100 is described. Compressor 100 may comprise a cylinder block 1, a front housing 2, a rear housing 3, and a drive shaft 7. Drive shaft 7 may pass through the center of front housing 2 and the center of cylinder block 1. Drive shaft 7 also may be rotatably supported by front housing 2 and by cylinder block 1 via a pair of bearings 8*a* and 8*b* mounted in front housing 2 and cylinder block 1, respectively. A plurality of cylinder bores 5 may be formed within cylinder block 1 and also may be positioned equiangularly around an axis of drive shaft 7. Moreover, a piston 16 may be slidably positioned within each cylinder bore 5, such that pistons 16 reciprocate in a direction parallel to the axis of drive shaft 7.

Compressor 100 also may comprise a driving mechanism (not numbered). The driving mechanism may comprise drive shaft 7, a rotor 9, a crank chamber 4, and a swash plate 6. Specifically, rotor 9 is fixed to drive shaft 7, such that drive shaft 7 and rotor 9 rotate together. Crank chamber 4 is formed between front housing 2 and cylinder block 1, and swash plate 6 may be positioned inside crank chamber 4. Swash plate 6 may include a penetration hole 6*c* formed therethrough at a center portion of swash plate 6, and drive shaft 7 may extend through penetration hole 6*c*. Moreover, rotor 9 and swash plate 6 may be connected by a hinge mechanism 11 comprising a pin (not numbered) and an oblong hole (not numbered) formed through hinge mechanism 11. Hinge mechanism 11 allows the tilt angle of swash plate 6 to vary with respect to drive shaft 7. The drive mechanism also may comprise a substantially ring-shaped wobble plate 14 and a connection rod 15, and compressor 100 further may comprise a rotation prevention mechanism 17. Wobble plate 14 may be rotatably attached to swash plate 6 by a thrust bearing 12 and a radial bearing 13, and may engage rotation prevention mechanism 17. Wobble plate 14 also may be connected to piston 16 by rod 15 and a pair of ball joints 15*a* and 15*b*. Moreover, rotation prevention mechanism 17 may prevent wobble plate 14 from rotating about the axis of drive shaft 7. Nevertheless, ball joints 15*a* and 15*b* may allow wobble plate 14 to move back and forth in a wobbling motion.

Referring to FIGS. 1–3, compressor 100 also may comprise a valve plate 20 positioned between cylinder block 1 and rear housing 3, and a suction chamber 18 formed between rear housing 3 and valve plate 20. Valve plate 20 may include a suction hole 20*a* formed therethrough, which may allow suction chamber 18 to be in fluid communication with cylinder bore 5, such that a fluid, e.g., a refrigerant introduced from an external refrigerant circuit (not shown), may flow from suction chamber 18 to cylinder bore 5. Valve plate 20 may comprise a suction valve reed 21 formed on a side, e.g., the left side, of valve plate 20. Suction valve reed 21 regulates the fluid communication between suction chamber 18 and cylinder bore 5. Moreover, a limiting recess 23' formed in cylinder block 1 and having a bottom surface 23*b* may limit the extent to which suction valve reed 21 may bend when fluid flows from suction chamber 18 to cylinder bore 5. Limiting recess 23' comprises an arced segment formed symmetrically about a center axis (X) of suction valve reed 21, such that axis (X) also is the center axis of limiting recess 23'.

Compressor 100 further may comprise a discharge chamber 19, and valve plate 20 further may include a discharge hole 20*b* formed therethrough. Discharge hole 20*b* may allow cylinder bore 5 to be in fluid communication with discharge chamber 19, such that a fluid, e.g., a refrigerant, may flow from cylinder bore 5 to discharge chamber 19. The refrigerant subsequently may be discharged from discharge chamber 19 to the external refrigerant circuit. Valve plate 20 also may comprise a discharge valve reed 22 formed on a side, e.g., the right side, of valve plate 20. Specifically, discharge valve reed 22 is formed on the side opposite the side which suction valve reed 21 is formed. Discharge valve reed 22 regulates the fluid communication between cylinder bore 5 and discharge chamber 19. Moreover, a valve retainer 30 formed on discharge valve reed 22 may limit the extent to which discharge valve reed 22 may bend when fluid flows from cylinder bore 5 to discharge chamber 19.

Compressor 100 also may comprise an electromagnetic clutch 24. When electromagnetic clutch 24 is activated, an external driving force from an external driving source (not shown) is transmitted to drive shaft 7, such that drive shaft 7, rotor 9, and swash plate 6 rotate substantially simultaneously about the axis of drive shaft 7. Moreover, wobble plate 14 moves back and forth in a wobbling motion without rotating about the axis of drive shaft 7, such that only a direction of movement which is parallel to the axis of drive shaft 7 is transferred from wobble plate 14 to pistons 16. Consequently, each piston 16 reciprocates within its corresponding cylinder bore 5 and compresses the fluid, e.g., the refrigerant, which flows into cylinder bore 5 from suction chamber 18 via suction hole 20*a*.

The reciprocation of piston 16 may be divided into a suction stroke and a discharge stroke. Specifically, during the suction stroke, discharge hole 20*b* may be closed by discharge valve reed 22, and during the discharge stroke, suction hole 20*a* may be closed by suction valve reed 21. Referring to FIGS. 2 and 3, during the suction stroke, the fluid generally flows in the direction of limiting recess 23' as indicated by the arrow (L1). When the fluid approaches or reaches limiting recess 23', the fluid deflects off a portion of limiting recess 23' which intersects with center axis (X) and has a tangent line at the point of intersection which is substantially perpendicular to center axis (X) of suction valve reed 21. As such, when the fluid approaches or reaches limiting recess 23', the direction of the flowing fluid changes by about 90° and the fluid flows in the directions indicated by the arrow (L2). Nevertheless, because the direction of the flowing fluid changes by about 90° when the fluid approaches or reaches limiting recess 23', the speed of the fluid decreases and the fluid may become stagnant within limiting recess 23'. Consequently, during the suction stroke, the suction efficiency of the compressor may decrease.

SUMMARY OF THE INVENTION

Therefore, a need has arisen for refrigerant compressor which overcomes these and other shortcomings of the related art. A technical advantage of the present invention is that during the suction stroke, when a fluid approaches or reaches a limiting recess, the fluid may not become stagnant.

Specifically, when the fluid approaches or reaches the limiting recess, the fluid may contact a portion of the limiting recess having a tangent line which forms an oblique angle relative to a center axis of a suction valve reed, i.e., an axis which is parallel to the direction of fluid flow. Consequently, when the fluid approaches or reaches the limiting recess, the fluid may deflect at an angle less than 90°, and the suction efficiency of the compressor may increase.

According to an embodiment of the present invention, a refrigerant compressor is described. The compressor comprises a front housing, a cylinder block, a rear housing, and a valve plate positioned between the cylinder block and the rear housing, in which the valve plate has a suction hole formed therethrough. The compressor also comprises a plurality of pistons each of which is slidably positioned within a corresponding cylinder bore, and a drive mechanism adapted to reciprocate each of the pistons within their corresponding cylinder bore. The compressor further comprises a suction chamber formed between the rear housing and the valve plate, and a suction valve reed formed on the valve plate which regulates the flow of a fluid through the suction hole. The compressor also comprises a limiting recess formed within an end of the cylinder block adapted to receive the suction valve reed. The limiting recess comprises at least one arced segment intersecting a center axis of the suction valve reed. Moreover, the portion of the at least one arced segment which intersects the center axis of the suction valve reed has a corresponding tangential line at the point of intersection which forms an oblique angle relative to the center axis of the suction valve reed.

According to another embodiment of the present invention, a refrigerant compressor is described. The compressor comprises a front housing, a cylinder block, a rear housing, and a valve plate positioned between the cylinder block and the rear housing, in which the valve plate has a suction hole formed therethrough. The compressor also comprises a plurality of pistons each of which is slidably positioned within a corresponding cylinder bore, and a drive mechanism adapted to reciprocate each of the pistons within their corresponding cylinder bore. The compressor further comprises a suction chamber formed between the rear housing and the valve plate, and a suction valve reed formed on the valve plate which regulates the flow of a fluid through the suction hole. The compressor also comprises a limiting recess formed within an end of the cylinder block adapted to receive the suction valve reed. Moreover, the limiting recess comprises a pair of arcs intersecting at or intersecting proximate to a center axis of the suction valve reed to form a ridge extending towards a center axis of the cylinder bore.

According to another embodiment of the present invention, a refrigerant compressor is described. The compressor comprises a front housing, a cylinder block, a rear housing, and a valve plate positioned between the cylinder block and the rear housing, in which the valve plate has a suction hole formed therethrough. The compressor also comprises a plurality of pistons each of which is slidably positioned within a corresponding cylinder bore, and a drive mechanism adapted to reciprocate each of the pistons within their corresponding cylinder bore. The compressor further comprises a suction chamber formed between the rear housing and the valve plate, and a suction valve reed formed on the valve plate which regulates the flow of a fluid through the suction hole. The compressor also comprises a limiting recess formed within an end of the cylinder block adapted to receive the suction valve reed. Moreover, the limiting recess comprises a pair of arcs intersecting at an axis offset from a center axis of the suction valve reed to form a ridge extending towards a center axis of the cylinder bore.

Other objects, features, and advantages will be apparent to persons of ordinary skill in the art in view of the following detailed description of the invention and the accompanying drawings.

BRIEF DESCRIPTION OF THE DRAWINGS

For a more complete understanding of the present invention, the needs satisfied thereby, and the features and advantages thereof, reference now is made to the following descriptions taken in connection with the accompanying drawings.

DETAILED DESCRIPTION OF PREFERRED EMBODIMENTS

Preferred embodiments of the present invention and their advantages may be more readily understood by referring to FIGS. 4–7, like numerals being used for like corresponding parts in the various drawings.

Figure 1:
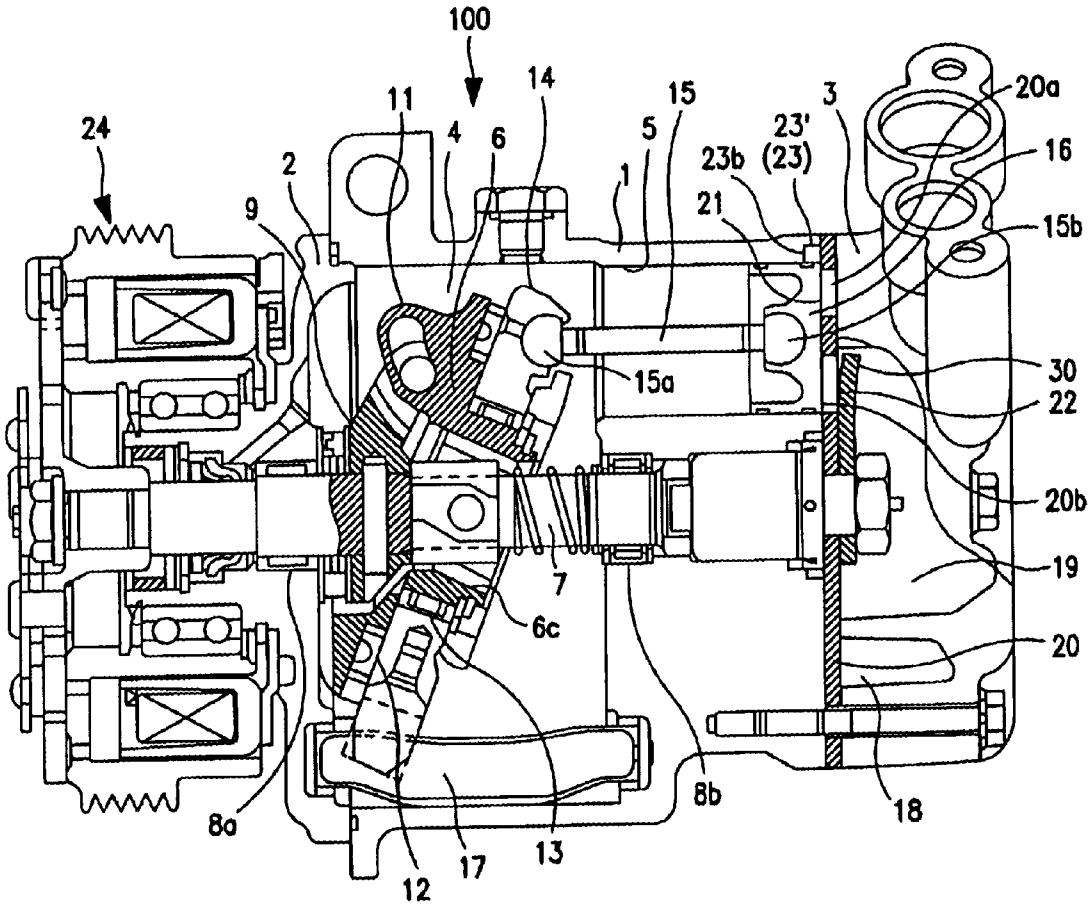
FIG. 1 PRIOR ART
FIG. 1 is a cross-sectional view of a known, wobble plate-type compressor.
Figure 2:
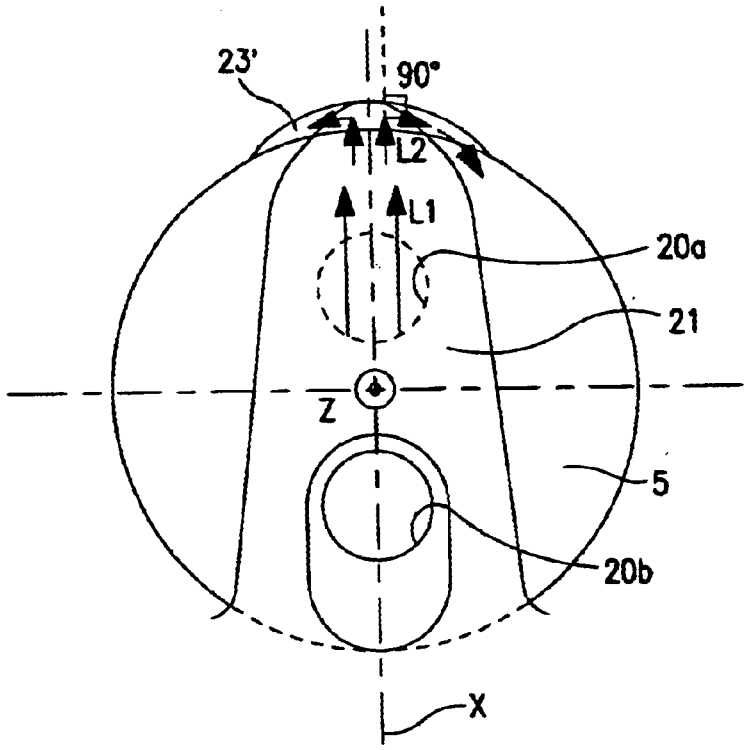
FIG. 2 PRIOR ART
FIG. 2 is an enlarged, plan view of a valve plate and a limiting recess of a known compressor.
Figure 3:
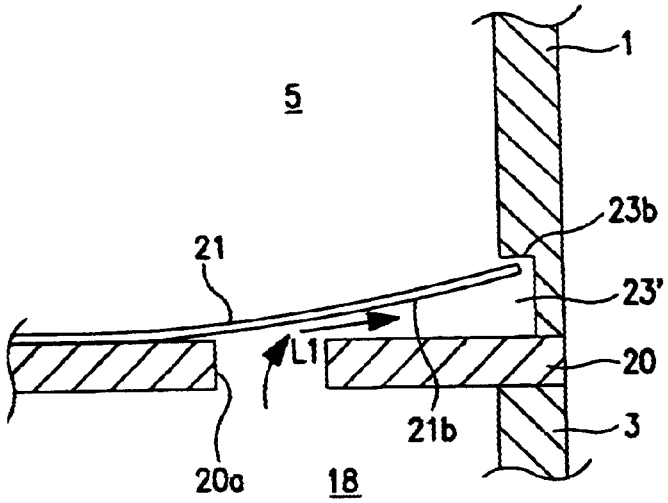
FIG. 3 PRIOR ART
FIG. 3 is an enlarged, cross-sectional view of a cylinder bore of a known compressor.
Figure 4:
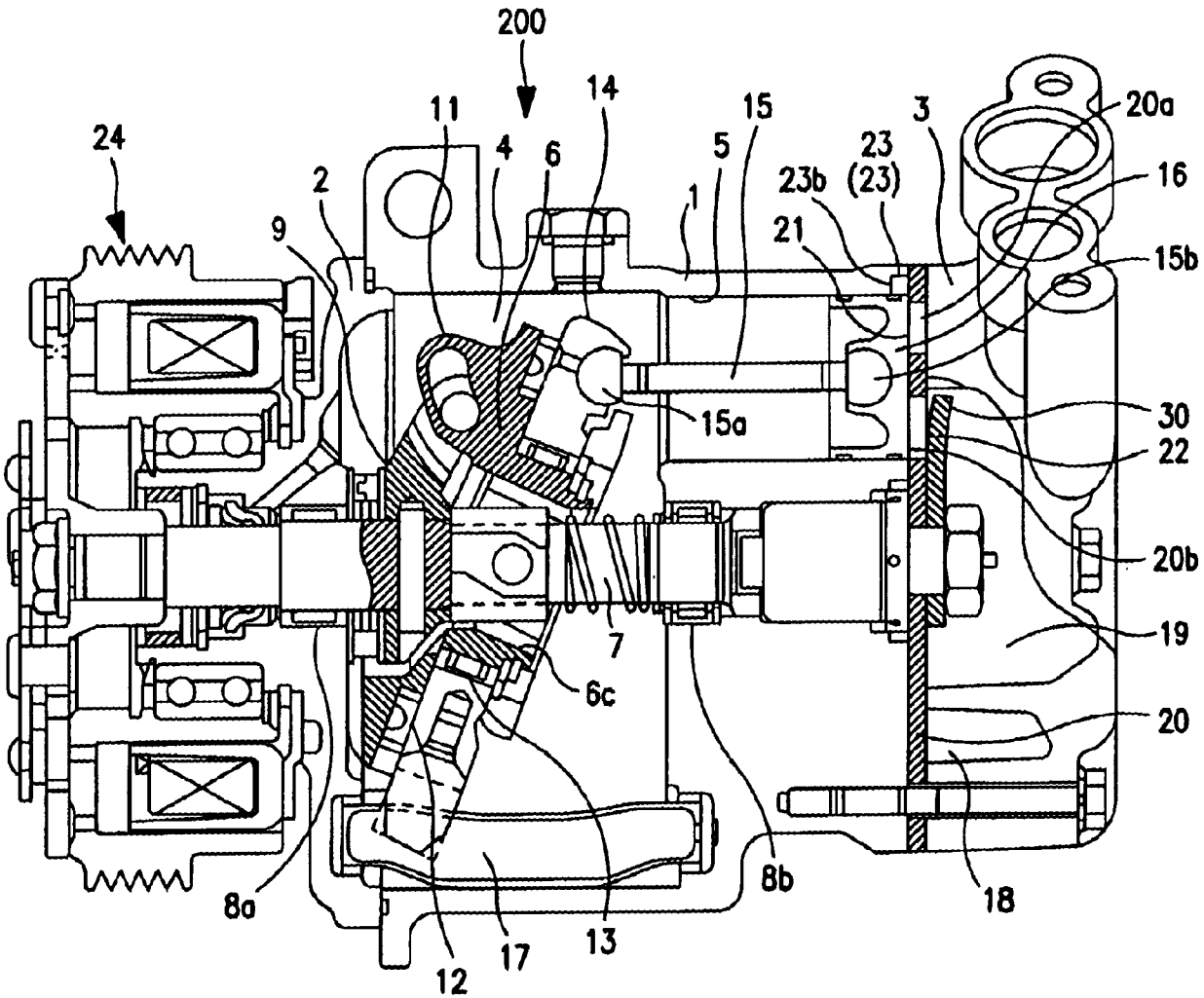
FIG. 4 is a cross-sectional view of a wobble plate-type compressor according to a first embodiment of the present invention.

Referring to FIG. 4, a refrigerant compressor 200 according to a first embodiment of the present invention is described. Although FIG. 4 depicts a wobble plate-type compressor, it will be understood by those of ordinary skill in the art that refrigerant compressors include wobble plate-type compressors, swash-plate type compressors, or the like, and that the present invention may be used in various types of refrigerant compressor, e.g., reciprocating compressors. Compressor 200 may comprise a cylinder block 1, a front housing 2, a rear housing 3, and a drive shaft 7. Drive shaft 7 may pass through the center of front housing 2 and the center of cylinder block 1. Drive shaft 7 may be rotatably supported by front housing 2 and by cylinder block 1 via a pair of bearings 8*a* and 8*b*, respectively. A plurality of cylinder bores 5 may be formed within cylinder block 1 and may be positioned equiangularly around an axis of drive shaft 7. Moreover, a plurality of pistons 16 may be slidably positioned within cylinder bores 5, such that pistons 16 reciprocate in a direction parallel to the axis of drive shaft 7.

Compressor 200 also comprises a drive mechanism (not numbered). The drive mechanism may comprise drive shaft 7, a rotor 9, a crank chamber 4, and a swash plate 6. Specifically, rotor 9 may be fixed to drive shaft 7, such that drive shaft 7 and rotor 9 rotate together. Crank chamber 4 is formed between front housing 2 and cylinder block 1, and swash plate 6 may be positioned inside crank chamber 4. Swash plate 6 may include a penetration hole 6*c* formed therethrough at a center portion of swash plate 6, and drive shaft 7 may extend through penetration hole 6*c*. Moreover, rotor 9 and swash plate 6 may be connected by a hinge mechanism 11 comprising a pin (not numbered) and an oblong hole (not numbered) formed through hinge mechanism 11. Hinge mechanism 11 allows the tilt angle of swash plate 6 to vary with respect to drive shaft 7. The drive mechanism also may comprise a substantially ring-shaped wobble plate 14 and a connection rod 15, and compressor 200 further may comprise a rotation prevention mechanism 17. Wobble plate 14 may be rotatably attached to swash plate 6 by a thrust bearing 12 and a radial bearing 13, and may engage rotation prevention mechanism 17. Wobble plate 14 also may be connected to piston 16 by rod 15 and a pair of ball joints 15*a* and 15*b*. Moreover, rotation prevention mechanism 17 may prevent wobble plate 14 from rotating about the axis of drive shaft 7. Nevertheless, ball joints 15*a* and 15*b* may allow wobble plate 14 to move in a back and forth wobbling motion.

Compressor 200 also may comprise a valve plate 20 positioned between cylinder block 1 and rear housing 3, and a suction chamber 18 formed between rear housing 3 and valve plate 20. Valve plate 20 may include a suction hole 20*a* formed therethrough, which allows suction chamber 18 to be in fluid communication with cylinder bore 5, such that a fluid, e.g., a refrigerant introduced from an external refrigerant circuit (not shown), may flow from suction chamber 18 to cylinder bore 5. Valve plate 20 may comprise a suction valve reed 21 formed on a side, e.g., the left side, of valve plate 20. Suction valve reed 21 regulates the fluid communication between suction chamber 18 and cylinder bore 5. Moreover, a limiting recess 23 formed in cylinder block 1 and having a bottom surface 23*b* may limit the extent to which suction valve reed 21 may bend when fluid flows from suction chamber 18 to cylinder bore 5.

Compressor 200 further may comprise a discharge chamber 19, and valve plate 20 further may include a discharge hole 20*b* formed therethrough. Discharge 20*b* may allow cylinder bore 5 to be in fluid communication with discharge chamber 19, such that a fluid, e.g., a refrigerant, may flow from cylinder bore 5 to discharge chamber 19. The refrigerant subsequently may be discharged from discharge chamber 19 to the external refrigerant circuit. Valve plate 20 also may comprise a discharge valve reed 22 formed on a side, e.g., the right side, of valve plate 20. Specifically, discharge valve reed 22 is formed on the side opposite the side which suction valve reed 21 is formed. Discharge valve reed 22 regulates the fluid communication between cylinder bore 5 and discharge chamber 19. Moreover, a valve retainer 30 formed on discharge valve reed 22 may limit the extent to which discharge valve reed 22 may bend when fluid flows from cylinder bore 5 to discharge chamber 19.

Compressor 200 also may comprise an electromagnetic clutch 24. When electromagnetic clutch 24 is activated, an external driving force from an external driving source (not shown) is transmitted to drive shaft 7, such that drive shaft 7, rotor 9, and swash plate 6 substantially simultaneously rotate about the axis of drive shaft 7. Moreover, wobble plate 14 moves back and forth in a wobbling motion without rotating about the axis of drive shaft 7, such that a direction of movement which is parallel to the axis of drive shaft 7 is transferred from wobble plate 14 to pistons 16. Consequently, each piston 16 reciprocates within its corresponding cylinder bore 5 and compresses the fluid, e.g., the refrigerant, which flows into cylinder bore 5 from suction chamber 18 via suction hole 20*a*.

Figure 5:
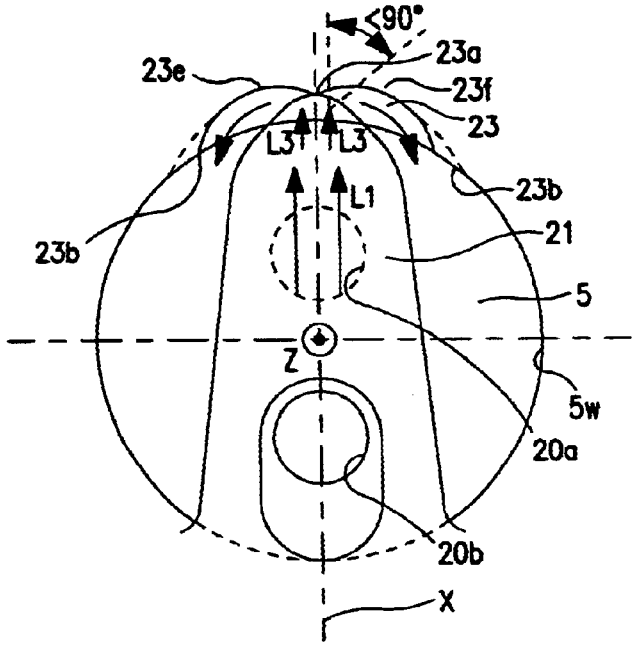
FIG. 5 is an enlarged, plan view of a valve plate and a limiting recess according to the first embodiment of the present invention.

Referring to FIG. 5, limiting recess 23 according to the first embodiment of the present invention is described in detail. In this embodiment, limiting recess 23 may comprise a pair of arced segments having curved walls 23*e* and 23*f*, respectively, which intersect at or intersect proximate to a center axis (X) of suction valve reed 21, such that limiting recess 23 is substantially symmetrical about center axis (X). In a modification of this embodiment, the portion of wall 23*e* or wall 23*f*, or both, which intersects with a circumferential portion 5 w of cylindrical bore 5, may be chamfered. Moreover, a center axis of each of the arced segments may be offset from center axis (X), such that the intersection of walls 23*e* and 23*f* at or proximate to center axis (X) forms a ridge 23*a* extending towards a center axis (Z) of cylinder bore 5. Specifically, ridge 23*a* is formed, such that walls 23*e* and 23*f* extend further away from center axis (Z) than ridge 23*a*, i.e. are further recessed than ridge 23*a*. Further, the point of intersection between walls 23*e* and 23*f*, i.e. ridge 23*a*, has a tangent line which forms an oblique angle relative to center axis (X).

During a suction stroke, the fluid, e.g., the refrigerant, generally flows in the direction of limiting recess 23 as indicated by the arrow (L1). When the fluid approaches or reaches limiting recess 23, the fluid divides and generally flows in the directions indicated by the arrow (L3). Nevertheless, because walls 23*e* and 23*f* extend further away from center axis (Z) than ridge 23*a*, the fluid initially deflects off ridge 23*a* and subsequently flows along walls 23*e* and 23*f*. Moreover, because the fluid initially deflects off ridge 23*a*, which is formed by the intersection of walls 23*e* and 23*f* at or proximate to center axis (X) and has a tangent line at the point of intersection which forms an oblique, i.e., slanting, angle relative to center axis (X), the angle of deflection of the fluid when the fluid approaches or reaches limiting recess 23 is less than 90°. Consequently, during the suction stroke, when the fluid approaches or reaches limiting recess 23, the fluid may not become stagnant, and the suction efficiency of compressor 200 may increase.

Figure 6:
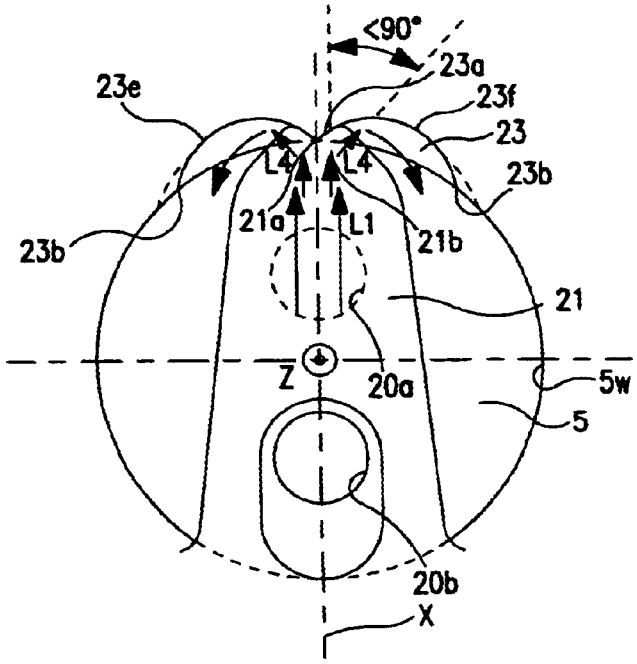
FIG. 6 is an enlarged, plan view of a valve plate and a limiting recess according to a second embodiment of the present invention.

Referring to FIG. 6, limiting recess 23 according to a second embodiment of the present invention is described. The features and advantages of this embodiment are substantially similar to those of the first embodiment. Therefore, the features and advantages of the first embodiment are not described further with respect to the second embodiment. In this embodiment, limiting recess 23 may comprise a pair of arced segments having curved walls 23*e* and 23*f*, respectively, intersecting at or intersecting proximate to a center axis (X) of suction valve reed 21, such that limiting recess 23 is substantially symmetrical about center axis (X). In a modification of this embodiment, the portion of wall 23*e* or wall 23*f*, or both, which intersects with a circumferential portion 5*w* of cylindrical bore 5, may be chamfered. Moreover, a center axis of each of the arced segments may be offset from center axis (X) such that an intersection of walls 23*e* and 23*f* at or proximate to center axis (X) may forms a ridge 23*a* extending towards a center axis (Z) of cylinder bore 5. Specifically, ridge 23*a* is formed such that walls 23*e* and 23*f* extend further away from center axis (Z) than ridge 23*a*, and ridge 23*a* extends into or is proximate to circumferential portion 5*w* of cylindrical bore 5. Further, the point of intersection between walls 23*e* and 23*f*, i.e., ridge 23*a*, has a tangent line which forms an oblique angle relative to center axis (X). Moreover, a notch 21*b* adapted to receive, but not touch ridge 23*a* may be formed in a tip 21*a* of suction valve reed 21.

Figure 7:
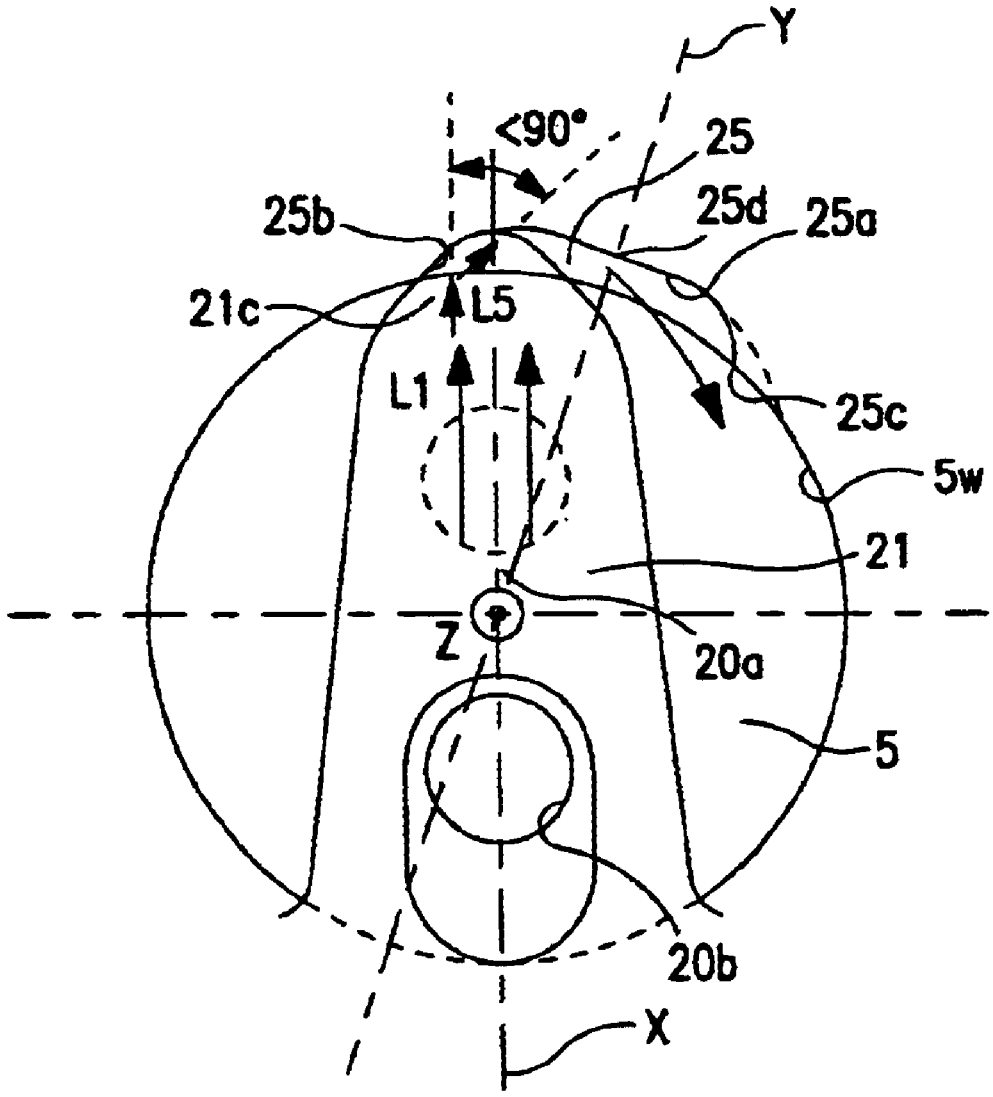
FIG. 7 is an enlarged, plan view of a valve plate and a limiting recess according to a third embodiment of the present invention.

Referring to FIG. 7, a limiting recess 25 according to a third embodiment of the present invention is described. The features and advantages of this embodiment are substantially similar to those of the foregoing embodiments. Therefore, the features and advantages of the foregoing embodiments are not described further with respect to the third embodiment. In this embodiment, limiting recess 25 may comprise a pair of arced segments having curved walls 25*a* and 25*b*, respectively, intersecting at an axis (Y) offset from center axis (X) of suction valve reed 21, such that limiting recess 25 is symmetrical about axis (Y). In a modification of this embodiment, the portion of wall 25*a* which intersects with a circumferential portion 5 w of cylindrical bore 5 may be chamfered. Moreover, a center axis of each of the arced segments may be offset from axis (Y) such that an intersection of walls 25*a* and 25*b* at axis (Y) may form a ridge 25*d* extending towards a center axis (Z) of cylinder bore 5. Moreover, a tip 21*c* of suction valve reed 21 may extend into limiting recess 25, such that tip 21*c* is proximate to, e.g., almost touches, at least a portion of crescent-shaped wall 25*b*.

During a suction stroke, the fluid, e.g., the refrigerant, generally flows in the direction parallel to center axis (X), as indicated by the arrow (L1). When the fluid approaches or reaches limiting recess 25, the fluid generally is deflected towards ridge 25*d* and wall 25*a* by a portion of wall 25*b* which intersects center axis (X), as indicated by the arrow (L5). Nevertheless, because the fluid deflects off a portion of limiting recess 25 intersecting center axis (X) and having a tangent line at that point of intersection which forms an oblique, i.e., slanting, angle relative to center axis (X), the angle of deflection of the fluid when the fluid approaches or reaches limiting recess 25 is less than 90°. Consequently, during the suction stroke, when the fluid approaches or reaches limiting recess 25, the fluid may not become stagnant and the suction efficiency of compressor 200 may increase.

While the invention has been described in connection with preferred embodiments, it will be understood by those skilled in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples are considered as exemplary.

What is claimed is:

1. A reciprocating compressor comprising:

a front housing;

a cylinder block, wherein a plurality of cylinder bores are formed within said cylinder block;

a rear housing;

a valve plate positioned between said cylinder block and said rear housing, wherein said valve plate has a suction hole formed therethrough;

a plurality of pistons, each of which is slidably positioned within a corresponding cylinder bore;

a drive mechanism adapted to reciprocate each of said pistons within said corresponding cylinder bore;

a suction chamber formed between said rear housing and said valve plate;

a suction valve reed formed on said valve plate, wherein said suction valve reed regulates the flow of a fluid through said suction hole; and a limiting recess formed within an end of said cylinder block adapted to receive said suction valve reed, wherein said limiting recess comprises at least one arced segment intersecting a center axis of said suction valve reed, such that the portion of said at least one arced segment intersecting said center axis of said suction valve reed has a corresponding tangential line at the point of intersection which forms an oblique angle relative to said center axis of said suction valve reed.

2. The compressor of claim 1, wherein said at least one arced segment comprises a pair of arced segments intersecting said center axis of said suction valve reed to form a ridge extending towards a center axis of said cylinder bore, wherein said ridge formed by said intersecting arced segments has a corresponding tangential line at the point of intersection which forms said oblique angle relative to said center axis of said suction valve reed.

3. A reciprocating compressor comprising:

a front housing;

a cylinder block, wherein a plurality of cylinder bores are formed within said cylinder block;

a rear housing;

a valve plate positioned between said cylinder block and said rear housing, wherein said valve plate has a suction hole formed therethrough;

a plurality of pistons, each of which is slidably positioned within a corresponding cylinder bore;

a drive mechanism adapted to reciprocate each of said pistons within said corresponding cylinder bore;

a suction chamber formed between said rear housing and said valve plate;

a suction valve reed formed on said valve plate, wherein said suction valve reed regulates the flow of a fluid through said suction hole; and a limiting recess formed within an end of said cylinder block adapted to receive said suction valve reed, wherein said limiting recess comprises a pair of arced segments intersecting at or intersecting proximate to a center axis of said suction valve reed to form a ridge extending towards a center axis of said cylinder bore.

4. The compressor of claim 3, wherein said limiting recess is substantially symmetrical about said center axis of said suction valve reed, and a tip of said suction valve reed extends into said limiting recess.

5. The compressor of claim 3, wherein said compressor is a swash plate-type compressor or a wobble plate-type compressor.

6. The compressor of claim 3, wherein said ridge extends into or is proximate to a circumferential portion of said cylinder bore.

7. The compressor of claim 3, wherein a first of said pair of arced segments intersect a first circumferential portion of said cylinder bore and a second of said pair of arced segments intersect a second circumferential portion of said cylinder bore, wherein the portion of each of said arced segments which intersect said cylinder bore are chamfered.

8. A reciprocating compressor comprising:

a front housing;

a cylinder block, wherein a plurality of cylinder bores are formed within said cylinder block;

a rear housing;

a valve plate positioned between said cylinder block and said rear housing, wherein said valve plate has a suction hole formed therethrough;

a plurality of pistons, each of which is slidably positioned within a corresponding cylinder bore;

a drive mechanism adapted to reciprocate each of said pistons within said corresponding cylinder bore;

a suction chamber formed between said rear housing and said valve plate;

a suction valve reed formed on said valve plate, wherein said suction valve reed regulates the flow of a fluid through said suction hole; and a limiting recess formed within an end of said cylinder block adapted to receive said suction valve reed, wherein said limiting recess comprises a pair of arced segments intersecting at an axis offset from a center axis of said suction valve reed to form a ridge extending towards a center axis of said cylinder bore.

9. The compressor of claim 8, wherein said limiting recess is substantially symmetrical about said axis offset from said center axis of said suction valve reed, and a tip of said suction valve reed extends into said limiting recess.

10. The compressor of claim 8, wherein said compressor is a swash plate-type compressor or a wobble plate-type compressor.

11. The compressor of claim 8, wherein a first of said pair of arced segments intersects a circumferential portion of said cylinder bore, and the portion of said first arced segment intersecting said circumferential portion of said cylinder bore is chamfered.

12. The compressor of claim 8, wherein a first of said pair of arced segments also intersects said center axis of said suction valve reed, such that the portion of said first arced segment intersecting said center axis of said suction valve reed has a corresponding tangential line at the point of intersection which forms an oblique angle relative to said center axis of said suction valve reed.

* * * * *